US005744291A

United States Patent [19]

Ip

[11] Patent Number: 5,744,291

[45] Date of Patent: Apr. 28, 1998

[54] 3D PHOTOGRAPHIC PRINT MATERIAL

[76] Inventor: Sunny Leong-Pang Ip, 1609 Walden Pond Rd., NW., Suwanee, Ga. 30174

[21] Appl. No.: 832,519

[22] Filed: Apr. 3, 1997

[51] Int. Cl.[6] ..... G03C 1/825

[52] U.S. Cl. ..... 430/504; 430/510; 430/946

[58] Field of Search ..... 430/504, 510, 430/946

[56] References Cited

U.S. PATENT DOCUMENTS

| | | | |
|---|---|---|---|
| 2,144,649 | 1/1939 | Eggert et al. | 430/946 |
| 4,040,830 | 8/1977 | Rogers | 430/946 |
| 4,629,667 | 12/1986 | Kistner et al. | 430/946 |
| 5,639,580 | 6/1997 | Morton | 430/946 |
| 5,681,676 | 10/1997 | Telfer et al. | 430/946 |

OTHER PUBLICATIONS

Color: Theory and Imaging Systems R.A. Eynard E., SPSE Pub. 1973 pp. 266–277.

*Primary Examiner*—Hoa Van Le

*Attorney, Agent, or Firm*—Kenneth Lao

[57] ABSTRACT

This disclosure concerns with a method of producing 3D print materials and the structure thereof. In the preferred embodiment of the present invention, the 3D print material consists of a lenticular screen, an image forming layer and an anti-halation layer coated on the image forming layer opposite from the lenticular screen. When the thickness of the lenticular screen reaches a certain amount, it renders the coating of an image forming layer onto the lenticular screen too difficult or impractical. With such a thickness, it is advantageous to coat the image forming layer and the anti-halation layer on a clear polymer base, and then securely attach the coated polymer base to a bare lenticular screen with the aid of a bonding layer. Similarly, a parallax barrier plate can be used in lieu of a lenticular screen for producing 3D print materials.

14 Claims, 6 Drawing Sheets

3D PHOTOGRAPHIC PRINT MATERIAL

BACKGROUND OF THE INVENTION

In 2D photography, the image forming medium, whether being a photographic film, a transparency material or a printing paper, is basically an image forming emulsion layer coated on a sheet of polymer or paper which serves as a substrate to support the emulsion. When the material is exposed to form an image, it is exposed from the emulsion side, and not from the substrate side.

The layer structure of the image forming media for 2D photography is well-known. As disclosed in the chapter entitled "Color Negative and Positive Silver Systems" by H. J. Bello (in "Color: Theory and Imaging Systems", R. A. Eynard, Ed., SPSE Publication, 1973, pp. 266–277), a color negative film, from top to bottom, consists of a gel overcoat to protect the emulsion layers from scratches and digs, a blue sensitive layer with yellow coupler, a yellow filtering interlayer, a green sensitive layer with magenta coupler, a gel interlayer to prevent color contaminations, a red sensitive layer with cyan coupler, an anti-halation layer and a transparent base or substrate. The anti-halation layer which is opaque prior to chemical processing is used for preventing the reflection of exposing light from the substrate and beyond. The layer order of the color emulsion layers in the above-described negative film is blue, green and red from top down. But other layer orders can also be used: red, green, blue; or green, red, blue from top down. However, the anti-halation layer, if existing, is always coated between the substrate and the bottom-most color sensitive emulsion layer, or on the other side of the substrate.

In 3D photography where a lenticular screen is used to compress a series of 2D images into one composite image, 2D images must be projected through the lenticules. If the lenticular screen is coated with an image forming layer to become a lenticular print material, then the lenticular screen itself also serves as the substrate to support the emulsion. With the lenticular print material, the exposure of images is carried out from the substrate side, and not from the emulsion side. Thus, exposing light must pass through the lenticular screen before reaching the color sensitive emulsion. For this unique requirement, the anti-halation layer cannot be coated between the substrate and the image forming layer, nor on the other side of the substrate.

It is essential to provide a method of producing a print material for making 3D displays with high image quality.

SUMMARY OF THE INVENTION

It is an objective of the present invention to provide a print material for making 3D displays and animation pictures with high image quality.

It is another objective of the present invention to provide a print material for making 3D displays and animation pictures with a desired thickness.

The above objectives can be achieved by first producing a lenticular screen having a flat side and an opposite side having an array of lenticules. Each lenticule is a cylindrical lens having a substantially identical surface curvature to define the focal plane of the lenticular screen. The thickness of the lenticular screen is designed such that the flat side of the screen is substantially located in the focal plane. Such a thickness is hereafter referred to as the confocal thickness. The flat side of the lenticular screen is then coated with an image forming layer which comprises a plurality of color sensitive emulsion layers each having a complementary color coupler, and a plurality of interlayers to separate the color emulsion layers. In order to prevent spurious image from being formed by the reflection of the exposing light after it has reached the end of the image forming layer, an anti-halation layer is provided at the bottom of the image forming layer to absorb the remaining light rays. The anti-halation itself is well-known in the photographic materials manufacturing industries. The anti-halation may contain silver coated in gelatin, or mordanted dye. It may also contain finely dispersed neutral particles which can be removed during chemical processing. It is essential that the anti-halation layer be opaque before chemical processing. But it may become transparent or translucent afterward.

When the thickness of a lenticular screen reaches a certain amount, it would render the direct coating of emulsion layer on the lenticular screen difficult and impractical. Under these circumstances, the lenticular print material must be produced in a different way. The print material can be produced by first making 1) a bare lenticular screen having a thickness smaller than the confocal thickness, and 2) an image forming layer coated on a dear polymer base or another substrate. The polymer base is then securely attached to the flat side of the lenticular screen. It is preferred that the polymer base is permanently attached to the lenticular screen with the aid of a dear bonding medium such as a double-sided tape, or a layer of adhesive with a desired thickness. It should be noted that the bonding medium is in contact with the other side of the polymer base, opposite from the image forming layer, so as to allow processing chemicals to reach the image forming layer easily during processing. The total thickness of the lenticular screen, the bonding medium and the polymer base, after taking into consideration the refractive index in each component, is substantially equal to the confocal thickness so that the image forming layer is substantially located in the focal plane of the lenticular screen. It is preferred that an anti-halation layer is coated on the image forming layer, opposite from the polymer base, to eliminate the unwanted images resulted from reflection during exposure. It is essential that the anti-halation is permeable to processing chemicals so as not to disrupt the normal interactions between the processing chemicals and the image forming layer.

It should be reminded that a lenticular screen is a view-separating screen which is used to compress a plurality of 2D views into one composite image during exposure, and to separate the compressed views in the composite image when the composite image is viewed to yield the 3D effects. The lenticular screen can be substituted by a parallax barrier plate. Therefore, the present invention also includes a 3D print material on which a parallax barrier plate is used as a view-separating screen.

The objectives of the present invention will become apparent upon reading the detailed description of the invention.

DETAILED DESCRIPTION OF THE DRAWING

Figure 1:
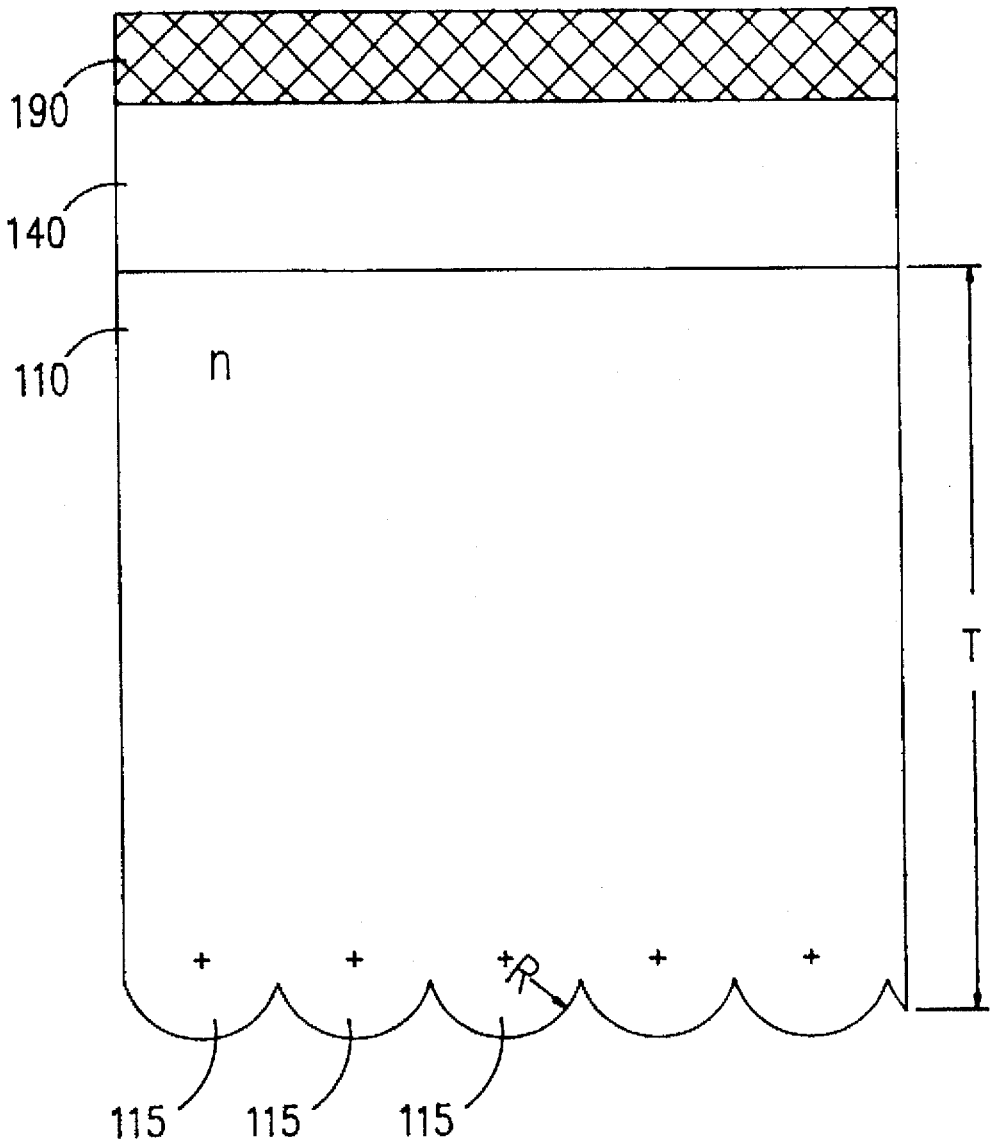
FIG. 1 shows the preferred embodiment of lenticular print material.

FIG. 1 shows the preferred embodiment of the lenticular print material for making 3D and animation pictures, according to the present invention. In FIG. 1, numeral 110 denotes a lenticular screen having a substantially flat surface and an opposite surface having an array of cylindrical lenses 115, or lenticules, each of which has a substantially identical radius of curvature, R, to define the focal plane of the lenticular screen. Letters T and n denote, respectively, the thickness and the refractive index of the lenticular screen. The thickness T is related to R by the following equation:

$$T=nR/(n-1)$$

The thickness T is referred to as the confocal thickness because the flat side of a lenticular screen that has such a thickness is located in the focal plane of the lenticular screen.

Numeral 140 denotes an image forming layer which collectively represents a plurality of color sensitive emulsion sub-layers and interlayers, as depicted in FIG. 2.

Numeral 190 denotes an anti-halation layer which is substantially opaque prior to being chemically processed and, preferably, becomes transparent or translucent after being processed. The anti-halation layer is used to prevent exposing light from reflecting back into the image forming layer after it has reached the end of the same layer. It is essential that the anti-halation layer is permeable to processing chemicals so as not to disrupt the normal photo processing. The lenticular print material depicted in FIG. 1 is intended for making 3D transparency displays where illumination is provided by back-lighting from the emulsion side. However, the same print material can also be used for making reflective 3D pictures where illumination is provided from the lenticular side. In the latter application, the lenticular print material as depicted can also have a reflective layer coated on top of the anti-halation layer, or to replace the anti-halation layer altogether. The reflective layer must also be permeable to processing chemicals.

Figure 2A:
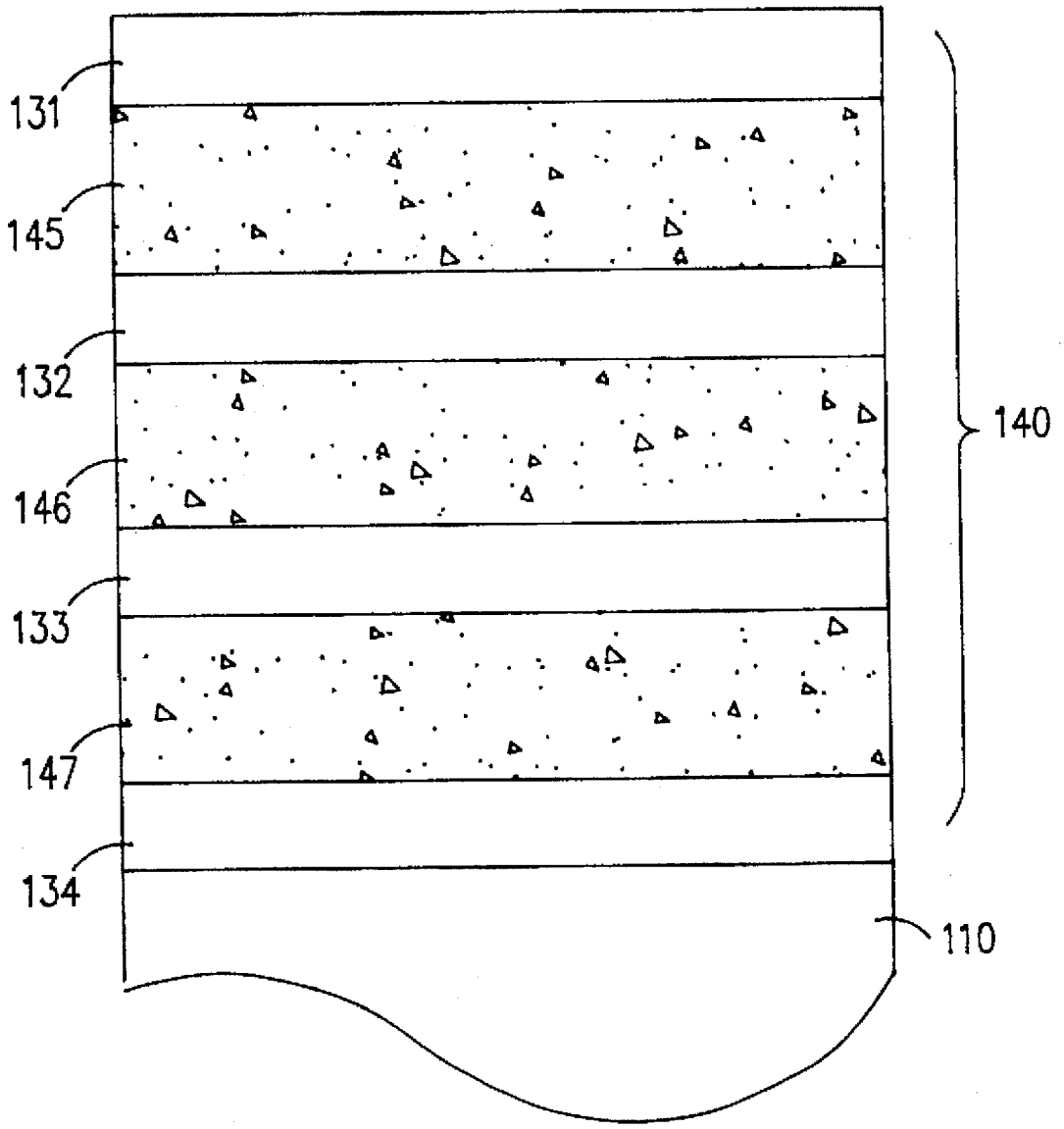
FIG. 2 shows different layer structures of the image forming layer containing a plurality of color sensitive emulsion sub-layers and interlayers.

FIG. 2 illustrates the various layer structures of the image forming layer the bottom side of which is in contact with the lenticular screen while the top side is in contact with the anti-halation layer, as shown in FIG. 1. In FIG. 2A, numerals 145, 146 and 147 denote, respectively, a sub-layer of red sensitive emulsion with cyan coupler, a sub-layer of green sensitive emulsion with magenta coupler, and a sub-layer of blue sensitive emulsion with yellow coupler. Numeral 131 denotes an optional interlayer which, if necessary, is provided on top of the image forming layer 140 so as to separate the red sensitive sub-layer 145 from the anti-halation layer. Numeral 134 denotes an interlayer, if necessary, being coated on the flat side of the lenticular screen 110 to improve the bonding of the color sensitive emulsion sub-layers to the lenticular screen. Interlayer 134 is also known as a subcoat for certain polymers. Numerals 132 and 133 denote interlayers for separating different color emulsion sub-layers to prevent interactions between sub-layers during the coating operations. Interlayer 133 can also be a yellow filter containing blue light absorbing materials to absorb the blue portion of the exposing light after it has passed through the blue emulsion sub-layer during exposure.

Figure 2B:
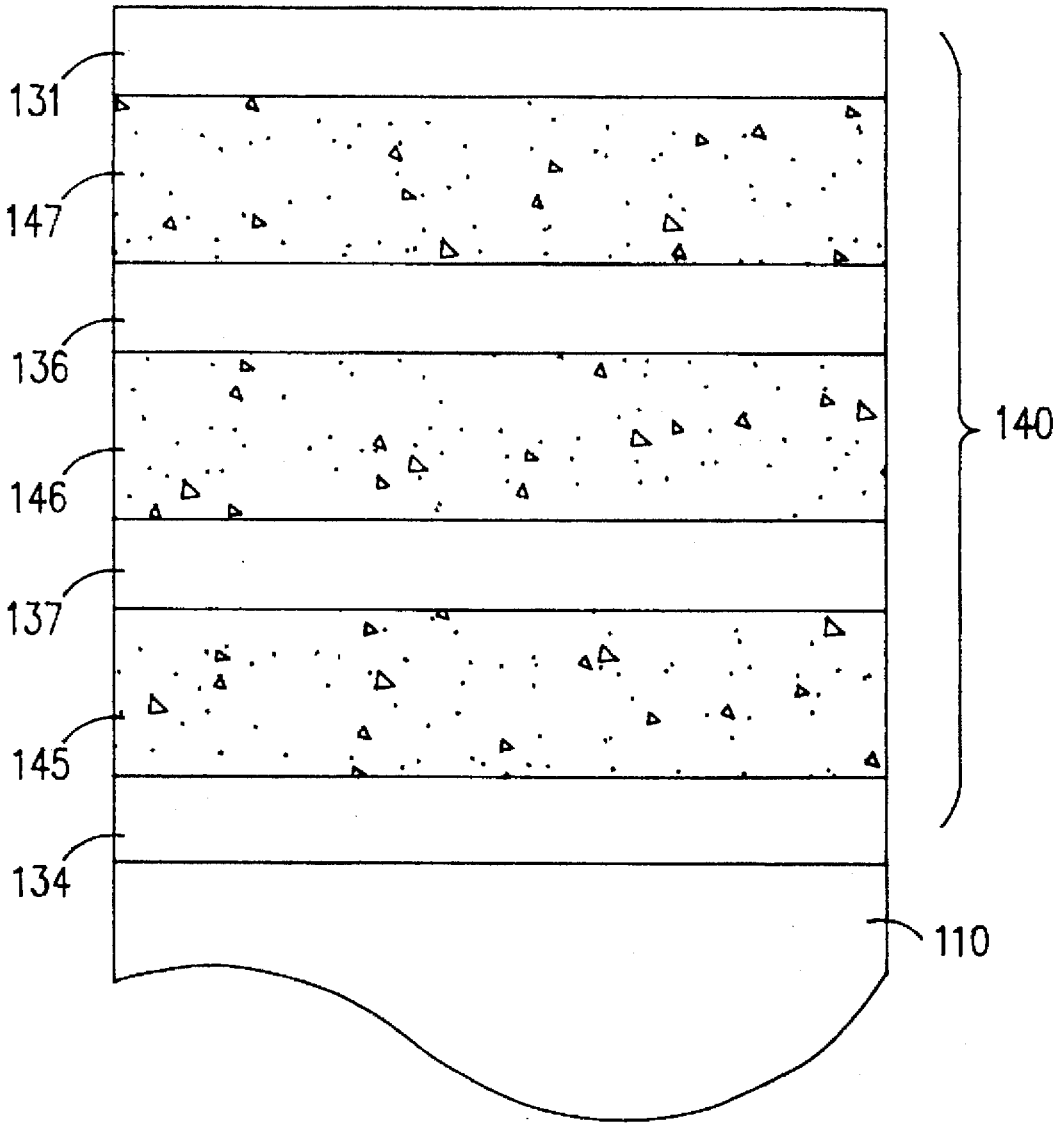

FIG. 2B illustrates another layer structure of the image forming layer. As with the structure shown in FIG. 2A, the image forming layer has an optional subcoat 134 to improve its bonding to the lenticular base, and another optional interlayer 131 to separate the anti-halation layer from the color emulsion. In FIG. 2B, the color emulsion sub-layers 145, 146 and 147 are arranged in the reversed order such that the blue sub-layer 147 is on top while the red sub-layer 145 is on the bottom. Numerals 136 and 137 denotes interlayers to separate adjacent color emulsion sub-layers.

Figure 2C:
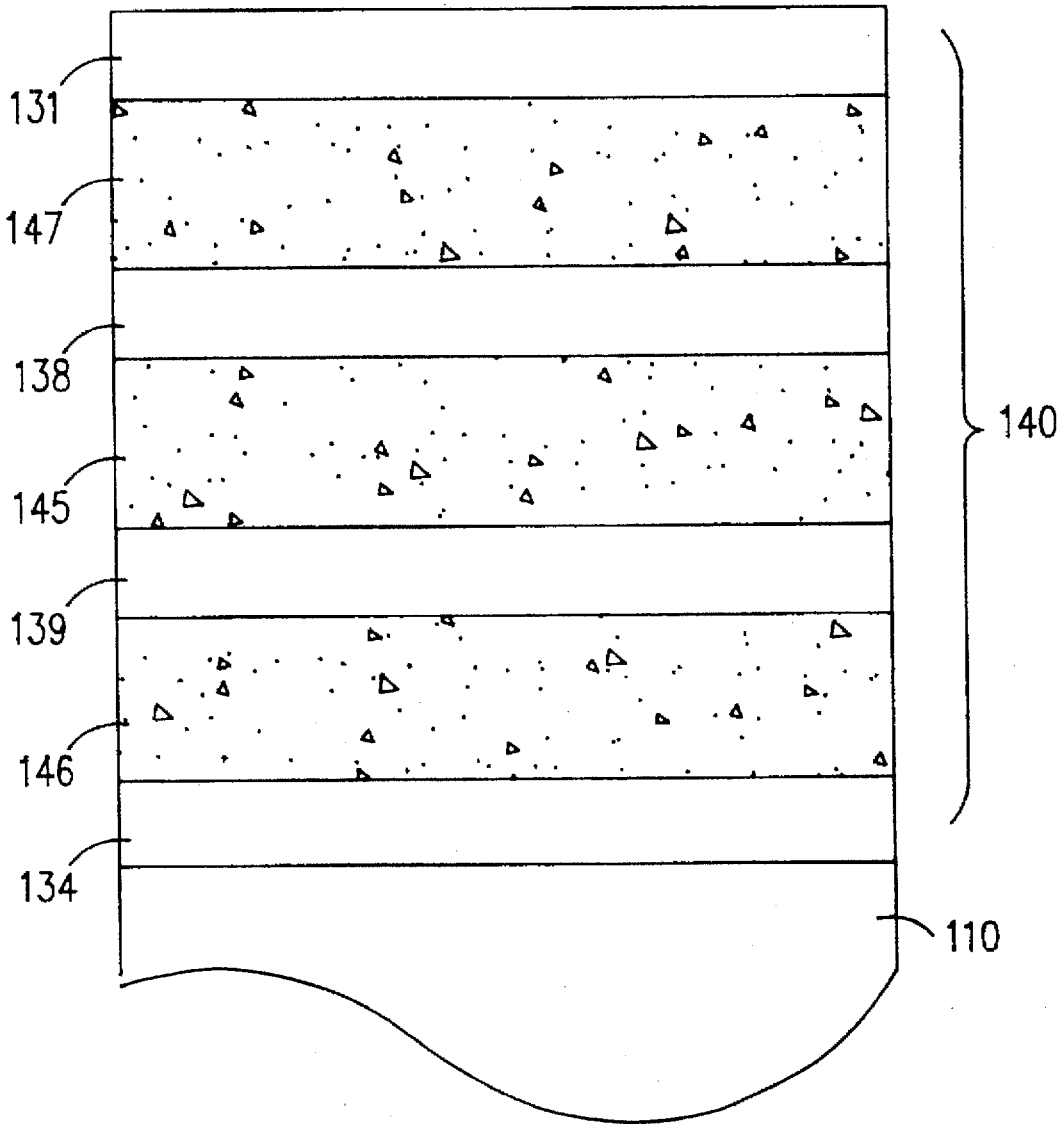

FIG. 2C illustrates yet another layer order of the image forming layer for maximizing the image sharpness. In this layer order, the green sensitive emulsion sub-layer 146 is coated first and, therefore, is closest to the lenticular screen while the blue sensitive emulsion sub-layer 147 is coated last. Numerals 138 and 139 are interlayers to separate adjacent sensitive emulsion sub-layers.

Figure 3:
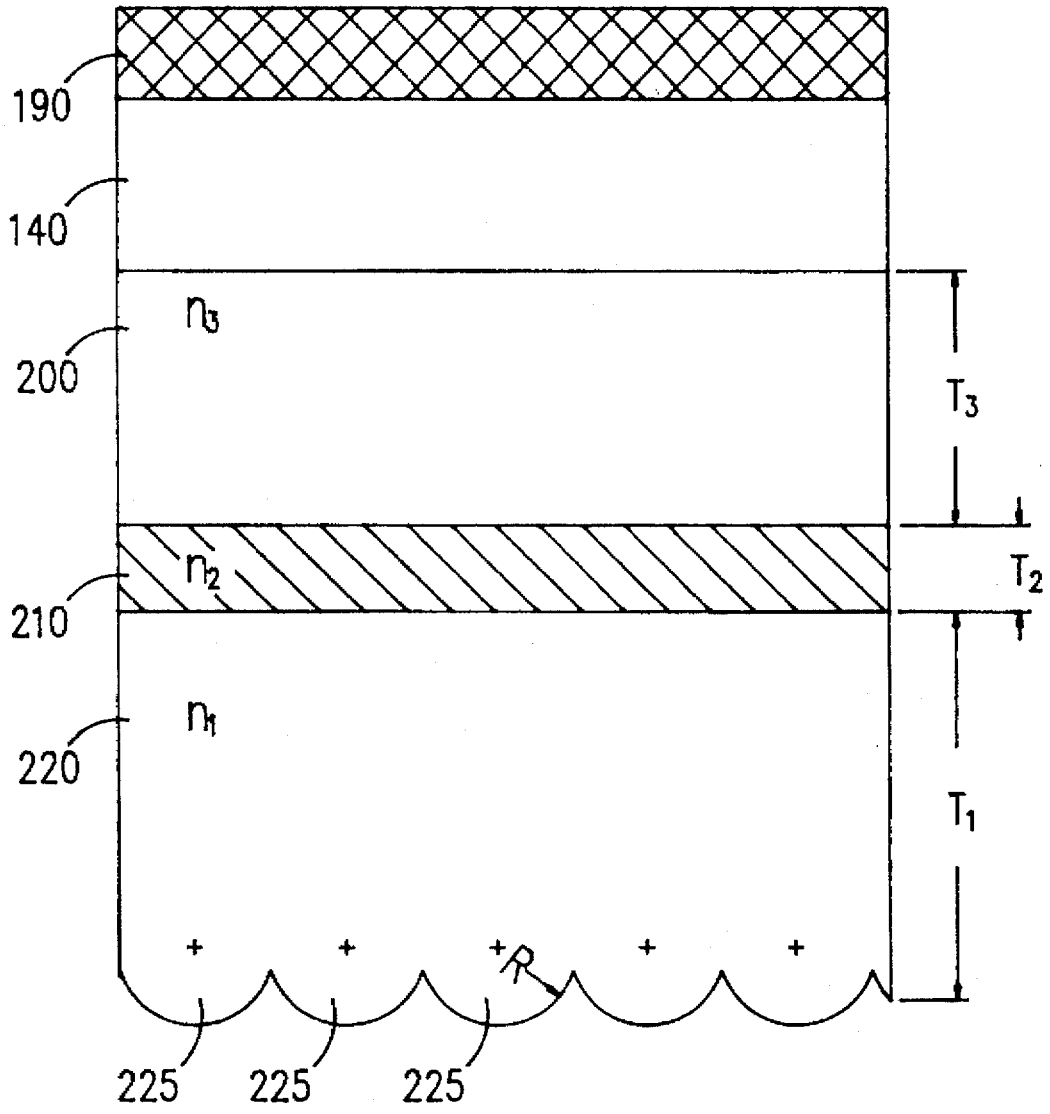
FIG. 3 shows another embodiment of the present invention wherein the image forming layer is first coated on a polymer base and the coated polymer base is then attached to a lenticular screen.

FIG. 3 shows another embodiment of the lenticular print material, according to the present invention. The structure of the lenticular print material, from top down, consists of an anti-halation layer 190, an image forming layer 140, a dear substrate or polymer base 200, a dear bonding layer 210 and a lenticular screen 220 having an array of lenticules 225 each having a surface curvature R. The anti-halation and the image forming layer are the same as those depicted in FIG. 1 and FIG. 2. This embodiment is necessary when the lenticular screen 220 is so thick that it is difficult or impractical to have a direct coating of the image forming layer on the lenticular screen. In order to circumvent this difficulty, the image forming layer 140 and the anti-halation layer can be first coated on the polymer base 220 which has a thickness $T_3$. The polymer base is then securely attached to the flat side of the lenticular screen 220 with the aid of the bonding layer 210. The bonding layer can be a double-sided tape, or a layer of adhesive, of a desired thickness $T_2$. The thickness $T_1$ of the lenticular screen 220, which is smaller than the confocal thickness, is chosen such that the sum of $T_1$, $T_2$, and $T_3$ is substantially equal to the confocal thickness of the lenticular screen, or $$T_1/n_1+T_2/n_2+T_3/n_3=R/(n_1-1)$$

where $n_1$, $n_2$ and $n_3$ are, respectively, the refractive indices of the lenticular screen, the bonding layer and the polymer base.

A reflective layer which is permeable to processing chemicals may also be coated on top of the anti-halation layer if the print material is used for making reflective 3D displays. Alternatively, a reflective layer is used in lieu of the anti-halation layer for making reflective 3D displays.

Figure 4A:
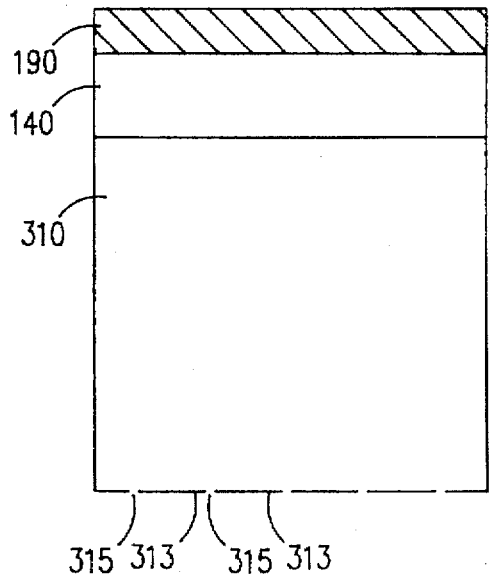
FIG. 4 shows a parallax barrier plate being used on a 3D print material in lieu of a lenticular screen.
Figure 4B:
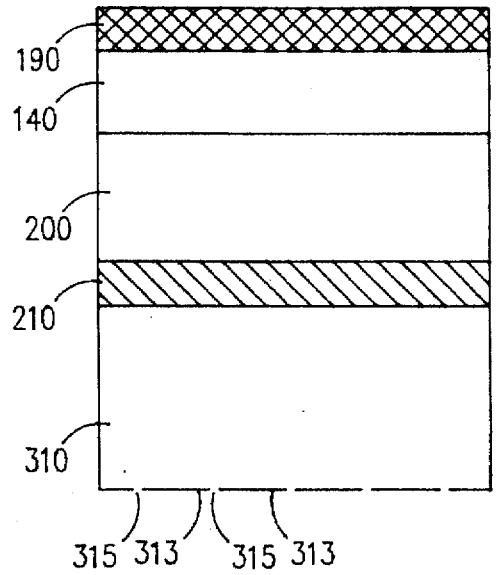

FIG. 4 illustrates a parallax barrier plate being used in lieu of a lenticular screen in a 3D print material. FIG. 4A shows a parallax barrier plate 310 having alternate blocking and clear strips 313 and 315. The parallax barrier is used in lieu of the lenticular screen 110 on the print material shown in FIG. 1. FIG. 4B shows a parallax barrier plate 310 being used in lieu of the lenticular screen 110 in the print material shown in FIG. 3. Like a lenticular screen, a parallax barrier is a view-separating screen. Like the lenticules on a lenticular screen, the blocking and dear strips on a parallax barrier plate are view-separating elements. It should be noted that the thickness of the parallax barrier strip is not very critical.

While the present invention has been disclosed in reference with the preferred embodiments, it shall be understood by those skilled in the art that various changes, modifications and substitutions may be incorporated into such embodiments without departing from the spirit of the invention as defined by the claims appearing hereafter.

What is claimed is:

1. A print material for making 3D and animation pictures consisting of:

a view-separating screen having a substantially flat first surface and a second surface having a multiplicity of view-separating elements;

an image forming layer disposed on the first surface of said view-separating screen; and an anti-halation layer coated on said image forming layer opposite from said view-separating screen.

2. The material of claim 1 wherein said image forming layer having a top side in contact with said anti-halation layer and a bottom side in contact with said view-separating screen, said image forming layer comprising:

an optional subcoat on the bottom side to improve the cohesion of said image forming layer and said view-separating screen;

a first sub-layer of red sensitive emulsion and cyan coupler disposed on top of said optional subcoat;

a first interlayer disposed on top of said first sub-layer to prevent color contaminations;

a second sub-layer of green sensitive emulsion and magenta coupler disposed on top of said first interlayer;

a second interlayer disposed on top of said second sub-layer to prevent color contaminations;

a third sub-layer of blue sensitive emulsion and yellow coupler disposed on top of said second interlayer; and an optional third interlayer disposed on top of said third sub-layer to separate said third sub-layer from said anti-halation layer during the coating process.

3. The material of claim 1 wherein said image forming layer having a top side in contact with said anti-halation layer and a bottom side in contact with said view-separating screen, said image forming layer bottom comprising:

an optional subcoat on the bottom side to improve the cohesion of said image forming layer and said view-separating screen;

a first sub-layer of blue sensitive emulsion and yellow coupler disposed on top of said optional subcoat;

a first interlayer disposed on top of said first sub-layer to prevent color contaminations;

a second sub-layer of green sensitive emulsion and magenta coupler disposed on top of said first interlayer;

a second interlayer disposed on top of said second sub-layer to prevent color contaminations;

a third sub-layer of red sensitive emulsion and cyan coupler disposed on top of said second interlayer; and an optional third interlayer disposed on top of said third sub-layer to separate said third sub-layer from said anti-halation layer during the coating process.

4. The material of claim 3 wherein said first interlayer contains at least one blue light absorbing material to reduce the blue portion of exposing light from reaching said second and third sub-layers.

5. The material of claim 1 wherein said image forming layer having a top side in contact with said anti-halation layer and a bottom side in contact with said view-separating screen, said image forming layer comprising:

an optional subcoat on the bottom side to improve the cohesion of said image forming layer and said lenticular screen;

a first sub-layer of green sensitive emulsion and magenta coupler disposed on top of said optional subcoat;

a first interlayer disposed on top of said first sub-layer to prevent color contaminations;

a second sub-layer of red sensitive emulsion and cyan coupler disposed on top of said first interlayer;

a second interlayer disposed on top of said second sub-layer to prevent color contaminations;

a third sub-layer of blue sensitive emulsion and yellow coupler disposed on top of said second interlayer; and an optional third intefiayer disposed on top of said third sub-layer to separate said third sub-layer from said anti-halation layer during the coating process.

6. The material of claim 1 wherein said view-separating screen is a lenticular screen and said view-separating elements are lenticules each having a substantially identical surface curvature to define the focal plane of said lenticular screen, said lenticular screen having a thickness such that said first surface is substantially located in the focal plane of said lenticular screen.

7. The material of claim 1 wherein said view-separating screen is a parallax barrier plate and said view-separating elements are composed of alternate blocking and clear strips.

8. A print material for making 3D and animation pictures consisting of:

a view-separating screen having a substantially flat first surface and a second surface having a multiplicity of view-separating elements;

a clear substrate having a first side, and a second side coated with an image forming layer;

a bonding layer disposed between the first surface of said view-separating screen and the first side of said clear substrate for cohesion; and an anti-halation layer coated on said image forming layer opposite from said clear substrate.

9. The material of claim 8 wherein said image forming layer having a top side in contact with said anti-halation layer and a bottom side in contact with said view-separating screen, said image forming layer comprising:

an optional subcoat on the bottom side to improve the cohesion of said image forming layer and said view-separating screen;

a first sub-layer of red sensitive emulsion and cyan coupler disposed on top of said optional subcoat;

a first interlayer disposed on top of said first sub-layer to prevent color contaminations;

a second sub-layer of green sensitive emulsion and magenta coupler disposed on top of said first interlayer;

a second interlayer disposed on top of said second sub-layer to prevent color contaminations;

a third sub-layer of blue sensitive emulsion and yellow coupler disposed on top of said second interlayer; and an optional third intefiayer disposed on top of said third sub-layer to separate said third sub-layer from said anti-halation layer during the coating process.

10. The material of claim 8 wherein said image forming layer having a top side in contact with said anti-halation layer and a bottom side in contact with said view-separating screen, said image forming layer bottom comprising:

an optional subcoat on the bottom side to improve the cohesion of said image forming layer and said view-separating screen;

a first sub-layer of blue sensitive emulsion and yellow coupler disposed on top of said optional subcoat;

a first interlayer disposed on top of said first sub-layer to prevent color contaminations;

a second sub-layer of green sensitive emulsion and magenta coupler disposed on top of said first interlayer;

a second interlayer disposed on top of said second sub-layer to prevent color contaminations;

a third sub-layer containing red sensitive emulsion and cyan coupler disposed on top of said second interlayer; and an optional third interlayer disposed on top of said third sub-layer to separate said third sub-layer from said anti-halation layer during the coating process.

11. The material of claim 10 wherein said first interlayer contains at least one blue light absorbing material to prevent the blue portion of exposing light from reaching said second and third sub-layers.

12. The material of claim 8 wherein said image forming layer having a top side in contact with said anti-halation layer and a bottom side in contact with said view-separating screen, said image forming layer comprising:

an optional subcoat on the bottom side to improve the cohesion of said image forming layer and said lenticular screen;

a first sub-layer of green sensitive emulsion and magenta coupler disposed on top of said optional subcoat;

a first interlayer disposed on top of said first sub-layer to prevent color contaminations;

a second sub-layer of red sensitive emulsion and cyan coupler disposed on top of said first interlayer;

a second interlayer disposed on top of said second sub-layer to prevent color contaminations;

a third sub-layer of blue sensitive emulsion and yellow coupler disposed on top of said second interlayer; and an optional third interlayer disposed on top of said third sub-layer to separate said third sub-layer from said anti-halation layer during the coating process.

13. The material of claim 8 wherein said view-separating screen is a lenticular screen and said view-separating elements are lenticules each having a substantially identical surface curvature to define the focal plane of said lenticular screen, said lenticular screen having a thickness such that said first surface is substantially located in the focal plane of said lenticular screen.

14. The material of claim 8 wherein said view-separating screen is a parallax barrier plate and said view-separating elements are composed of alternate blocking and clear strips.

* * * * *